US011506992B2

(12) United States Patent
Nomura et al.

(10) Patent No.: US 11,506,992 B2
(45) Date of Patent: Nov. 22, 2022

(54) POWDER CONTAINER AND IMAGE FORMING APPARATUS

(71) Applicants: Ricoh Company, Ltd., Tokyo (JP); Yasushi Tanaka, Tonami (JP)

(72) Inventors: Masato Nomura, Suwanee, GA (US); Yuuta Tanaka; Seiji Terazawa, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/338,019

(22) Filed: Jun. 3, 2021

(65) Prior Publication Data

US 2021/0382412 A1 Dec. 9, 2021

(30) Foreign Application Priority Data

Jun. 5, 2020 (JP) ..... JP2020-098425

(51) Int. Cl.
*G03G 15/08* (2006.01)

(52) U.S. Cl.
CPC ..... *G03G 15/0872* (2013.01); *G03G 15/0877* (2013.01)

(58) Field of Classification Search
CPC ..... G03G 15/0877; G03G 15/0872
See application file for complete search history.

(56) References Cited

U.S. PATENT DOCUMENTS

| | | | |
|---|---|---|---|
| 2013/0216269 | A1 | 8/2013 | Yamabe et al. |
| 2015/0293474 | A1 | 10/2015 | Mitsuishi et al. |
| 2016/0033898 | A1 | 2/2016 | Yamabe et al. |
| 2016/0124346 | A1 | 5/2016 | Yamabe et al. |
| 2016/0161885 | A1 | 6/2016 | Hosokawa et al. |
| 2016/0202632 | A1 | 7/2016 | Mitsuishi et al. |
| 2016/0252846 | A1 | 9/2016 | Suiseki et al. |
| 2017/0102638 | A1 | 4/2017 | Yamabe et al. |
| 2017/0139350 | A1 | 5/2017 | Yano et al. |
| 2019/0243286 | A1 | 8/2019 | Tanaka et al. |
| 2020/0142331 | A1 | 5/2020 | Hosokawa et al. |
| 2020/0192243 | A1 | 6/2020 | Kitamura et al. |

FOREIGN PATENT DOCUMENTS

| | | | |
|---|---|---|---|
| JP | 7-020705 | | 1/1995 |
| JP | 2014-199395 | | 10/2014 |
| JP | 2014228647 A | * | 12/2014 |

OTHER PUBLICATIONS

JP_2014228647_A_I MachineTranslation, Masashi, Japan, 2014.*
Titanium Dioxide classified as suspected carcinogen.*

* cited by examiner

*Primary Examiner* — Victor Verbitsky
(74) *Attorney, Agent, or Firm* — Xsensus LLP

(57) ABSTRACT

A powder container includes a container body, a spiral projection, and a convex portion. The container body stores powder and is rotatable around an axis of the container body. The spiral projection is inside the container body. The convex portion includes a flat surface portion and protrudes inward from an inner wall surface of the container body. A virtual plane including the flat surface portion passes through the axis.

13 Claims, 4 Drawing Sheets

POWDER CONTAINER AND IMAGE FORMING APPARATUS

CROSS-REFERENCE TO RELATED APPLICATION

This patent application is based on and claims priority pursuant to 35 U.S.C. § 119(a) to Japanese Patent Application No. 2020-098425, filed on Jun. 5, 2020, in the Japan Patent Office, the entire disclosure of which is incorporated by reference herein.

BACKGROUND

Technical Field

Aspects of the present disclosure relate to a tubular powder container and an image forming apparatus.

Related Art

Image forming apparatuses such as copying machines to which a tubular powder container (toner bottle) is detachably attached are widely known. Such a powder container has a spiral projection (spiral groove) formed inside. As the powder container is rotationally driven around the axis, the powder (toner) that is stored inside is conveyed in the axial direction and discharged to the outside through the opening of the container.

SUMMARY

In an aspect of the present disclosure, there is provided a powder container that includes a container body, a spiral projection, and a convex portion. The container body stores powder and is rotatable around an axis of the container body. The spiral projection is inside the container body. The convex portion includes a flat surface portion and protrudes inward from an inner wall surface of the container body. A virtual plane including the flat surface portion passes through the axis.

In another aspect of the present disclosure, there is provided a powder container that includes a container body, a spiral projection, and a flat surface portion. The container body stores powder and is rotatable around an axis of the container body. The spiral projection is inside the container body. The flat surface portion stands inward from an inner wall surface of the container body to be substantially orthogonal to a parting line of the container body.

In still another aspect of the present disclosure, there is provided a powder container that includes a container body, a spiral projection, and a convex portion. The container body stores powder and has a cylindrical surface extending in a longitudinal direction of the container body. The spiral projection is inside the container body. The convex portion includes a flat surface portion and protrudes inward from an inner wall surface of the container body. The flat surface portion protrudes toward a center of the container body in a cross section of the container body perpendicular to the longitudinal direction.

In still yet another aspect of the present disclosure, there is provided an image forming apparatus that includes the powder container. The powder container is detachably attached in the image forming apparatus.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
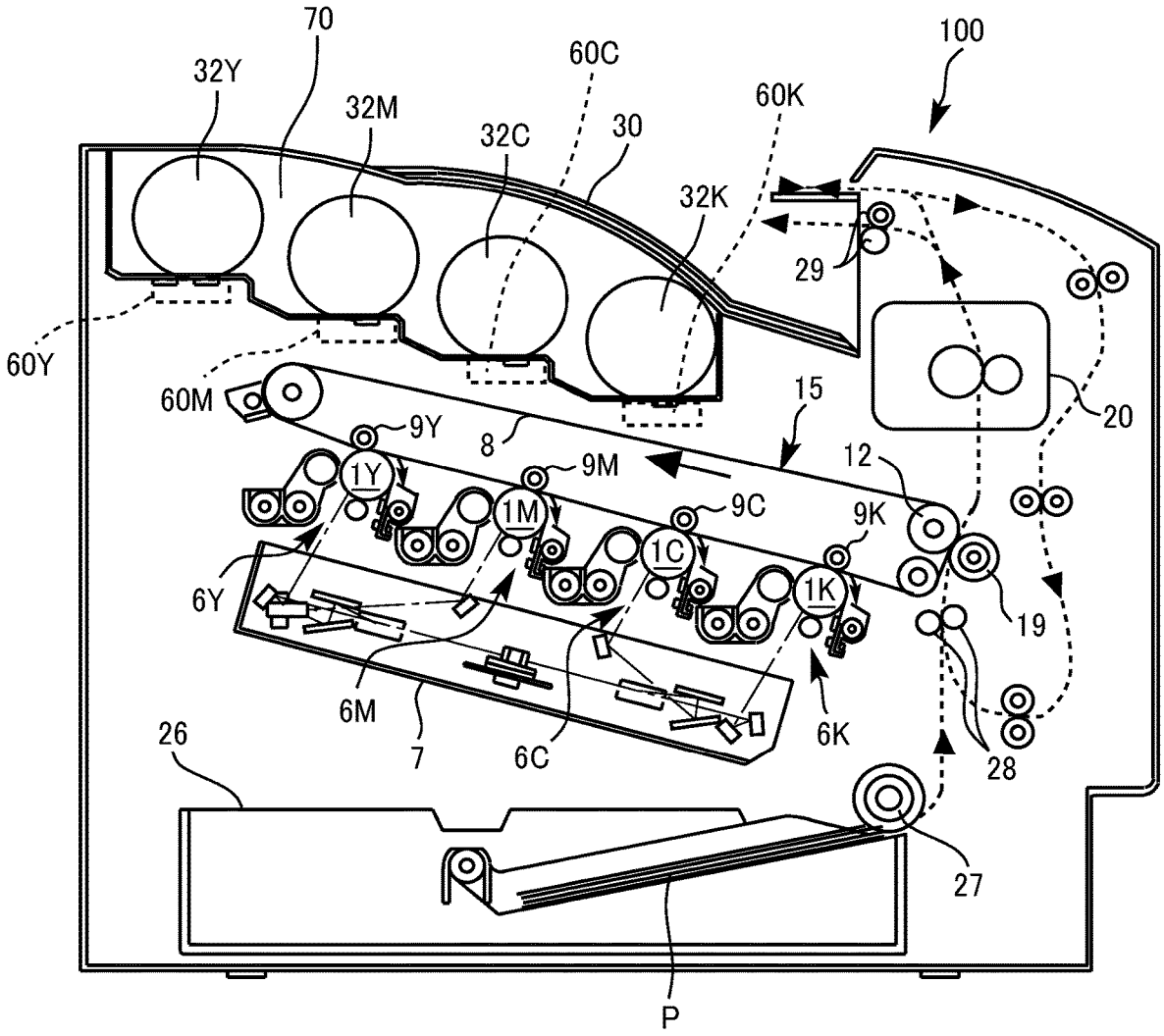
FIG. 1 is a schematic diagram illustrating an overall configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 3:
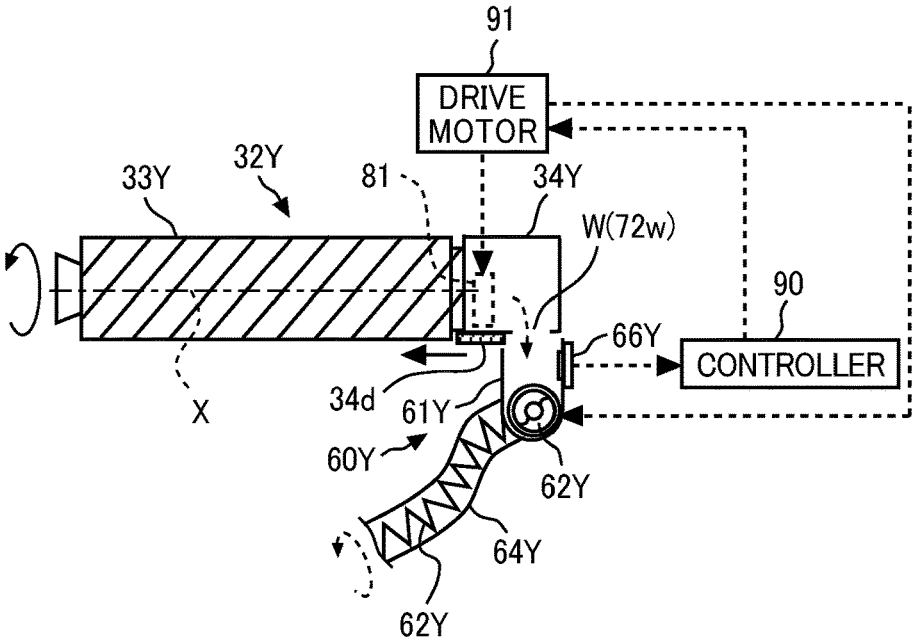
FIG. 3 is a schematic diagram illustrating a toner supply device on which a toner container is mounted according to an embodiment of the present disclosure.

First, an overall configuration and operation of an image forming apparatus 100 are described. As illustrated in FIG. 1 and FIG. 3, a toner container mount 70 that is disposed in an upper portion of the image forming apparatus 100 is provided with four powder containers of multiple colors including yellow, magenta, cyan, and black. Toner containers 32Y, 32M, 32C, and 32K are detachably and replaceably disposed. An intermediate transfer unit 15 is disposed below the toner container mount 70. Image forming units 6Y, 6M, 6C, and 6K are disposed side by side, facing an intermediate transfer belt 8 of the intermediate transfer unit 15 to form toner images of yellow, magenta, cyan, and black, respectively. Toner supply devices 60Y, 60M, 60C, and 60K as powder replenishing devices are disposed below the toner containers 32Y, 32M, 32C, and 32K, respectively. Then, the toner that is contained in the toner containers 32Y, 32M, 32C, and 32K, each of which serves as a powder container, is replenished by the toner supply devices 60Y, 60M, 60C, and 60K, into the developing devices of the image forming units 6Y, 6M, 6C, and 6K, respectively.

Figure 2:
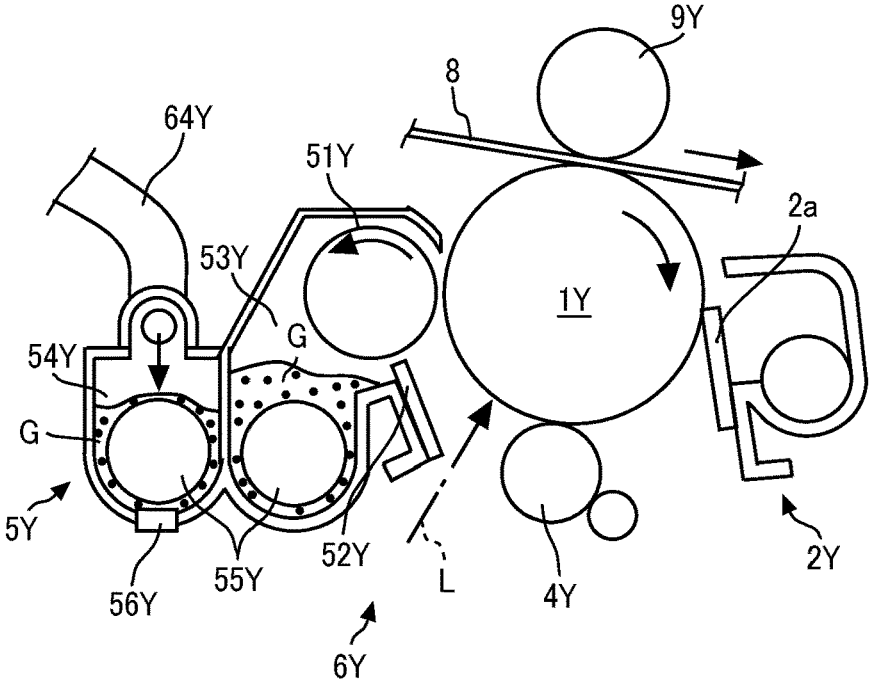
FIG. 2 is a cross-sectional view of an image forming unit of the image forming apparatus in FIG. 1.

FIG. 2 is a cross-sectional view of the image forming unit 6Y of the image forming apparatus 100, according to the present embodiment. As illustrated in FIG. 2, the image forming unit 6Y for yellow includes, for example, a photoconductor drum 1Y that serves as an image bearer, a charging device 4Y, a developing device 5Y, a cleaning device 2Y, and a discharging device that are disposed around the photoconductor drum 1Y. Image forming processes that include, for example, charging, exposure, development, transfer, cleaning, and discharging processes are performed on the photoconductor drum 1Y, to form a yellow toner image on the surface of the photoconductor drum 1Y.

The configuration of the other three image forming units 6M, 6C, and 6K is equivalent to the configuration of the image forming unit 6Y corresponding to yellow, except the toner color used in each one of the image forming units. Thus, only the image forming unit 6Y is described below, and the descriptions of the other three image forming units 6M, 6C, and 6K are omitted where appropriate.

As illustrated in FIG. 2, the photoconductor drum 1Y is rotated clockwise in FIG. 2 by a motor. The charging device 4Y uniformly charges the surface of the photoconductor drum 1Y, and this process is referred to as a charging process. When the surface of the photoconductor drum 1Y reaches a position where the surface of the photoconductor drum 1Y is irradiated with a laser beam L emitted from an exposure device 7 (see FIG. 1), the photoconductor drum 1Y is scanned with the laser beam L, and an electrostatic latent image of yellow is formed thereon. This process is referred to as an exposure process.

Then, the surface of the photoconductor drum 1Y reaches a position opposite the developing device 5Y, where the electrostatic latent image is developed with toner into a yellow toner image. This process is referred to as a development process. When the surface of the photoconductor drum 1Y bearing the toner image reaches a position opposite a primary transfer roller 9Y via the intermediate transfer belt 8, the toner image on the photoconductor drum 1Y is transferred onto the intermediate transfer belt 8. This process is referred to as a primary transfer process. At this time, a small amount of untransferred toner (residual toner) may remain on the surface of the photoconductor drum 1Y.

When the surface of the photoconductor drum 1Y reaches a position opposite the cleaning device 2Y, a cleaning blade 2*a* of the cleaning device 2Y mechanically collects the untransferred toner on the photoconductor drum 1Y. This process is referred to as a cleaning process. Finally, the surface of the photoconductor drum 1Y reaches a position opposite the discharge device, and the residual potential is removed from the surface of the photoconductor drum 1Y. Thus, the series of image forming processes performed on the surface of the photoconductor drum 1Y is completed.

Note that the other image forming units 6M, 6C, and 6K perform the series of image forming processes described above in substantially the same manner as the image forming unit 6Y. In other words, the exposure device 7 that is disposed below the image forming units 6M, 6C, and 6K irradiates the photoconductor drums 1M, 1C, and 1K of the image forming units 6M, 6C, and 6K with the laser beams L based on image data. Then, the toner images that are formed on the photoconductor drums 1M, 1C, and 1K through the development process are transferred therefrom and superimposed on the intermediate transfer belt 8. Thus, a multicolor toner image is formed on the intermediate transfer belt 8.

As illustrated in FIG. 1, an intermediate transfer unit 15 includes, for example, the intermediate transfer belt 8, the four primary transfer rollers 9Y, 9M, 9C, and 9K, a secondary transfer counter roller 12, multiple tension rollers, and an intermediate-transfer cleaning device. The intermediate transfer belt 8 is stretched around and supported by the multiple rollers and is rotated in the direction indicated by arrow A1 illustrated in FIG. 1 as the secondary transfer counter roller 12, which is one of the multiple rollers that serves as a drive roller, rotates.

The four primary transfer rollers 9Y, 9M, 9C, and 9K sandwich the intermediate transfer belt 8 together with the four photoconductor drums 1Y, 1M, 1C, and 1K, respectively, to form the four primary transfer nips between the intermediate transfer belt 8 and the photoconductor drums 1Y, 1M, 1C, and 1K. A primary transfer bias opposite in polarity to the toner is applied to the primary transfer rollers 9Y, 9M, 9C, and 9K. The intermediate transfer belt 8 travels in the direction indicated by arrow in FIG. 1 and sequentially passes through the primary transfer nips formed by the four primary transfer rollers 9Y, 9M, 9C, and 9K. Thus, the yellow, magenta, cyan, and black toner images on the photoconductor drums 1Y, 1M, 1C, and 1K are primarily transferred to and superimposed on the intermediate transfer belt 8, thereby forming a multicolor toner image.

Subsequently, the intermediate transfer belt 8 bearing the multicolor toner image reaches a position opposite a secondary transfer roller 19. At the position facing the secondary transfer roller 19, the secondary transfer counter roller 12 sandwiches the intermediate transfer belt 8 with the secondary transfer roller 19 to form a secondary transfer nip. The four-color toner images (yellow, magenta, cyan, and black) superimposed on the intermediate transfer belt 8 are secondarily transferred onto a sheet P (e.g., a paper) conveyed through the secondary transfer nip in a secondary transfer process. At this time, an untransferred toner may remain on the intermediate transfer belt 8 as residual toner. The surface of the intermediate transfer belt 8 then reaches a position opposite the intermediate-transfer cleaning device. At this position, the intermediate-transfer cleaning device collects the untransferred toner from the intermediate transfer belt 8. Thus, a series of transfer processes performed on the outer circumferential surface of the intermediate transfer belt 8 is completed.

The sheet P is conveyed from a sheet feeder 26 disposed in a lower portion of the main body of the image forming apparatus 100 to the secondary transfer nip via a feed roller 27, a registration roller pair 28, and the like. More specifically, the sheet feeder 26 contains a stack of multiple sheets P (e.g., paper sheets) piled on one another. As the feed roller 27 rotates counterclockwise in FIG. 1, the feed roller 27 feeds a top sheet P from the stack in the sheet feeder 26 to the roller nip between the registration roller pair 28.

The sheet P that is conveyed to the registration roller pair 28 stops moving at the roller nip of the registration roller pair 28 that stops rotating temporarily. Subsequently, the registration roller pair 28 rotates to convey the sheet P to the secondary transfer nip, timed to coincide with the arrival of the multicolor toner image on the intermediate transfer belt 8. Thus, the desired color toner image is transferred onto the sheet P.

Subsequently, the sheet P onto which the multicolor image is transferred at the secondary transfer nip is conveyed to a fixing device 20. Then, at this position, the color image that has been transferred to the surface of the sheet P is fixed on the sheet P by the heat and pressure of the fixing roller and the pressure roller. Thereafter, the sheet P that bears the fixed toner image is conveyed through the roller nip formed by an output roller pair 29 and ejected by the output roller pair 29 to the outside of the image forming apparatus 100. The sheets P that is ejected through the output roller pair 29 are sequentially stacked as output images on a stack tray 30. Thus, a series of image forming processes by the image forming apparatus 100 is completed.

Next, a detailed description is provided of a configuration and operations of the developing device 5Y of the image forming unit 6Y with reference to FIG. 2. The developing device 5Y includes, for example, a developing roller 51Y disposed opposite the photoconductor drum 1Y, a doctor blade 52Y disposed opposite the developing roller 51Y, two conveying screws 55Y disposed in developer containers 53Y and 54Y, and a toner concentration sensor 56Y, to detect concentration of toner in a developer G. The developing roller 51Y includes, for example, magnets and a sleeve. The magnets are secured inside the developing roller 51Y. The sleeve rotates around the magnets. The developer containers 53Y and 54Y contain the two-component developer G including carrier and toner. The developer container 54Y communicates, via an opening on an upper side thereof, with a toner conveying tube 64Y.

The developing device 5Y described above operates as follows. The sleeve of the developing roller 51Y rotates in a direction indicated by arrow in FIG. 2. The developer G is carried on the developing roller 51Y by a magnetic field generated by the magnets. As the sleeve rotates, the developer G moves along the circumference of the developing roller 51Y.

The developer G in the developing device 5Y is adjusted so that the ratio of toner (toner concentration) in the developer G is within a specified range. More specifically, the toner supply device 60Y (see, for example, FIGS. 3 and 5) supplies toner (as powder) from the toner container 32Y to the developer container 54Y according to the toner consumption in the developing device 5Y. The configuration and operation of the toner supply device 60Y are described in detail later.

The two conveying screws 55Y mix and stir the developer G with the toner supplied to the developer container 54Y while circulating the developer G in the two developer containers 53Y and 54Y. In this case, the developer G moves in the direction perpendicular to the plane on which FIG. 2 is illustrated. The toner in the developer G is electrically charged by friction with the carrier and thus is attracted to the carrier. Both the toner and the carrier are borne on the developing roller 51Y due to a magnetic force generated on the developing roller 51Y.

The developer G borne on the developing roller 51Y is conveyed in the direction indicated by arrow in FIG. 2 and reaches a position opposite the doctor blade 52Y. At this position, the doctor blade 52Y adjusts the amount of the developer G on the developing roller 51 to an appropriate amount. Thereafter, the developer G on the developing roller 51Y is conveyed to a position opposite the photoconductor drum 1Y (i.e., a developing area). In the developing area, the toner is attracted to the latent image formed on the photoconductor drum 1Y by an electric field generated in the developing area. As the sleeve rotates, the developer G remaining on the developing roller 51Y reaches an upper part of the developer container 53Y and is separated from the developing roller 51Y.

Next, the toner supply devices 60Y, 60M, 60C, and 60K are described below in detail with reference to, for example, FIGS. 3 to 5. FIG. 3 is a schematic diagram illustrating the toner supply device 60Y on which the toner container 32Y is mounted, according to the present embodiment. As illustrated in, for example, FIG. 3, the respective color toners in the toner containers 32Y, 32M, 32C, and 32K installed in the toner container mount 70 in the main body of the image forming apparatus 100 are supplied to the corresponding developing devices 5Y, 5M, 5C, and 5K by the toner supply devices 60Y, 60M, 60C, and 60K provided for the respective color toners according to the amount of toner consumed in the corresponding developing devices 5Y, 5M, 5C, and 5K. It is to be noted that the four toner supply devices 60Y, 60M, 60C, and 60K have a similar structure, and the four toner containers 32Y, 32M, 32C, and 32K have a similar structure except for the color of toner used in the image forming processes. Therefore, only the toner supply device 60Y and the toner container 32Y for yellow are described below as representatives, and descriptions of the toner supply devices 60M, 60C, and 60K and the toner containers 32M, 32C, and 32K for the other three colors are omitted to avoid redundancy.

Figure 4:
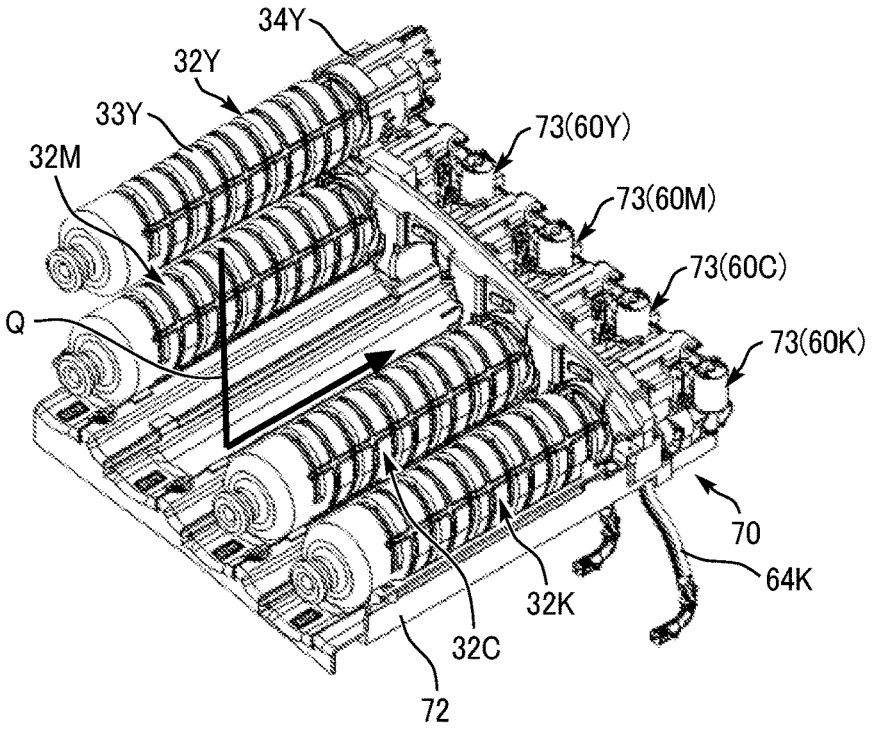
FIG. 4 is a schematic perspective view of a toner container mount on which a plurality of toner containers are mounted, according to an embodiment of the present disclosure.

FIG. 4 is a schematic perspective view of the toner container mount 70 to which the multiple toner containers 32Y, 32M, 32C, 32K are attached, according to the present embodiment. As illustrated in FIG. 4, when the toner containers 32Y, 32M, 32C, and 32K are installed in the toner container mount 70 in the main body of the image forming apparatus 100 (movement along the direction indicated by arrow Q), shutters 34*d* (see FIG. 3) of the toner containers 32Y, 32M, 32C, and 32K are moved in conjunction with the installation of the toner containers 32Y, 32M, 32C, and 32K and toner outlets W (see FIG. 3) of the toner containers 32Y, 32M, 32C, and 32K are opened. Consequently, the toner outlets W of the toner containers 32Y, 32M, 32C, and 32K communicate with toner inlets 72*w* (see FIG. 3) of the toner container mount 70 (the toner supply devices 60Y, 60M, 60C, and 60K). Accordingly, toner contained in the toner containers 32Y, 32M, 32C, and 32K is discharged from the toner outlets W, passes through the toner inlets 72*w* of the toner container mount 70 (the toner supply devices 60Y, 60M, 60C, and 60K), and then, is stored in a toner tank 61Y of the toner supply device 60Y.

Figure 5:
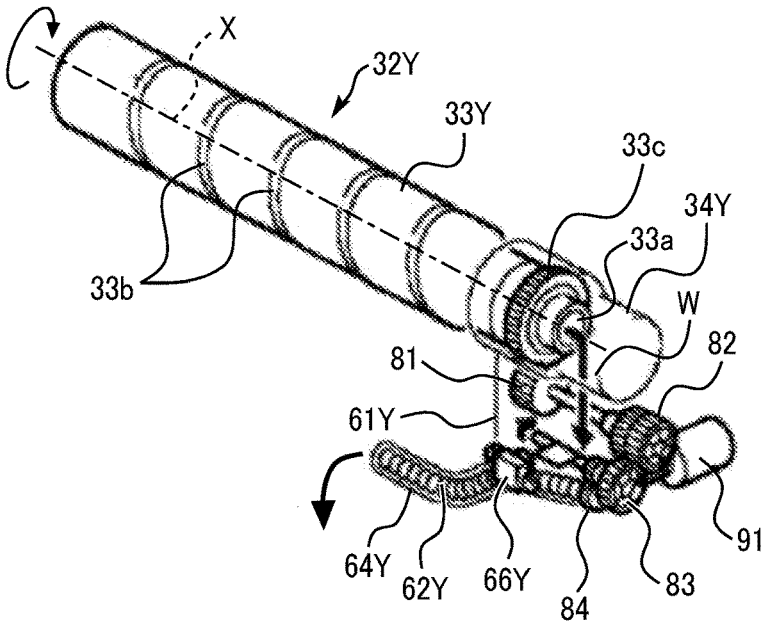
FIG. 5 is a perspective view of main parts of a toner supply device and a toner container, according to an embodiment of the present disclosure.

FIG. 5 is a perspective view of main parts of the toner supply device 60Y and the toner container 32Y, according to the present embodiment. As illustrated in, for example, FIG. 3 and FIG. 5, the toner container 32Y is a substantially cylindrical toner bottle and includes a cap 34Y and a container body (bottle body) 33Y formed together with a gear 33*c* (see FIG. 5). The cap 34Y is held by the toner container mount 70 so as not to rotate. The container body 33Y is held so as to rotate relative to the cap 34Y and driven to rotate by a driver in the direction indicated by arrows illustrated in FIGS. 3, 5, and 6. The driver includes, for example, a drive motor 91, a gear 81, and a gear 82. Then, as the container body 33Y rotates around the axis X, the toner contained in the toner container 32Y (container body 33Y) is conveyed in the axial direction (conveyed from the left side to the right side in FIG. 3) by a projection 33*b* (see FIG. 5) spirally formed on the inner wall surface (inner peripheral surface) of the container body 33Y, and the toner is conveyed from an opening 33*a* of the container body 33Y to the cap 34Y. Further, the toner is discharged from the toner outlet W of the cap 34Y to the outside of the toner container 32Y. In other words, the drive motor 91 rotates the container body 33Y of the toner container 32Y as required, thereby supplying the toner to the toner tank 61Y. Note that the toner containers 32Y, 32M, 32C, and 32K are replaced with new ones when the respective service lives thereof have expired, in other words, when almost all toner contained in the toner container 32 has been depleted.

With reference to FIGS. 3 and 5, the toner supply devices 60Y, 60M, 60C, and 60K as powder replenishing devices include, for example, the toner container mount 70, the toner tank 61Y, a conveying coil 62Y as a conveyor, and a toner end sensor 66Y, the drive motor 91, the gear 81, the gear 82, a gear 83, and the gear 84. The toner tank 61Y is disposed below the toner outlet W of the toner container 32Y to store toner discharged through the toner outlet W of the toner container 32Y. A bottom of the toner tank 61Y is coupled to an upstream end of the toner conveying tube 64Y in the direction in which the toner is conveyed. The toner end sensor 66Y is disposed on a side wall of the toner tank 61Y at a specified height from the bottom and detects that the amount of toner stored in the toner tank 61Y has fallen to a specified amount or less. For example, a piezoelectric sensor can be used as the toner end sensor 66Y When a controller 90 detects that the amount of toner stored in the toner tank 61Y is a specified amount or less by the toner end sensor 66Y, the controller 90 controls the drive motor 91 (including the gears 81 to 84) to rotate the container body 33Y of the toner container 32Y for a specified period, and to supply toner to the toner tank 61Y. If the toner end sensor 66Y continues to detect "toner end" even when this operation is repeated for a specified number of times, the controller 90 controls to display that the toner container 32Y is empty (toner depletion) on a control panel of the main body of the image forming apparatus 100 to prompt a user to replace the toner container 32Y.

As illustrated in FIGS. 3 and 5, the conveying coil 62Y is rotatably installed in the toner conveying tube 64Y, and the toner stored in the toner tank 61Y is conveyed to the developing device 5Y via the toner conveying tube 64Y. More specifically, the conveying coil 62Y is rotationally driven by the drive motor 91 to convey toner from the bottom (bottom point) of the toner tank 61Y toward the upper side of the developing device 5Y along the toner conveying tube 64Y. Then, the toner conveyed by the conveying coil 62Y is supplied into the developing device 5Y (the developer container 54Y). In the present embodiment, a driving source of the conveying coil 62Y is shared with the driving source of the toner container 32Y (container body 33Y). In other words, when the drive motor 91 is rotationally driven, the toner container 32Y rotates and the conveying coil 62Y also rotates.

Further, referring to FIG. 4, the toner container mount 70 mainly includes a cap holder 73 for holding the cap 34Y of the toner container 32Y and a bottle holder 72 for holding the container body 33Y of the toner container 32Y. With reference to FIG. 1, as a front cover of the main body of the image forming apparatus 100 (on the front side in the direction perpendicular to the plane on which FIG. 1 is illustrated) is opened, the toner container mount 70 is exposed. The toner containers 32Y, 32M, 32C, and 32K are installed and removed from the front side of the main body of the image forming apparatus 100, in the axis direction (longitudinal direction) of the toner containers 32Y, 32M, 32C, and 32K as the installation direction, with the longitudinal axis of the toner containers 32Y, 32M, 32C, and 32K kept horizontal. More specifically, when mounted on the main body of the image forming apparatus 100, the toner containers 32Y, 32M, 32C, and 32K are disposed on the toner container mount 70 from above the main body of the image forming apparatus 100 with the main body cover open. Then, the toner containers 32Y, 32M, 32C, and 32K are pushed in the horizontal direction with the cap 34Y at the head (movement along an arrow Q in FIG. 4). By contrast, when the toner containers 32Y, 32M, 32C, and 32K are separated from the main body of the image forming apparatus 100, the toner containers 32Y, 32M, 32C, and 32K are operated in the reverse order of mounting.

A configuration and an operation of the toner container 32Y serving as the powder container according to the present embodiment are described below. As described above with reference to, for example, FIGS. 3 to 5, the toner container 32Y in the present embodiment is a tubular powder container that stores toner as powder, and has an axis X that is the central axis of rotation extending in the longitudinal direction (axial direction). The toner container 32Y is rotatably formed around the axis X, and the spiral projection 33*b* is formed inside the toner container 32Y. More specifically, in the present embodiment, the spiral projection 33*b* is formed in a groove shape (concave shape) from the outer peripheral surface side to the inner peripheral surface side of the toner container 32Y (see, for example, FIGS. 4 and 5). Then, as described above, the toner container 32Y (container body 33Y) is rotationally driven, and the screw effect of the spiral projection 33*b* causes the toner contained in the toner container 32Y to be well conveyed toward the opening 33*a* in the axis direction (longitudinal direction).

Figure 6:
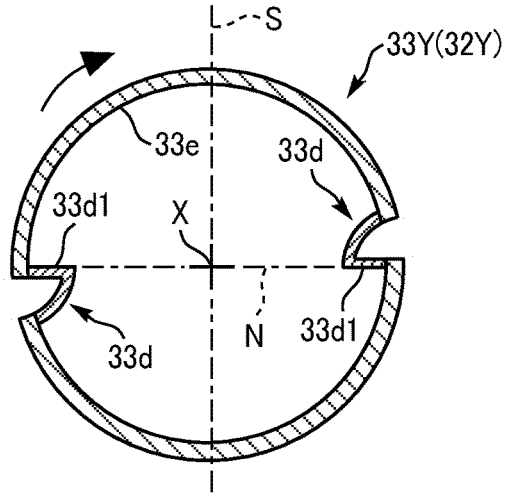
FIG. 6 is a cross-sectional view of a toner container, where the cross section is orthogonal to the axis of the toner container, according to an embodiment of the present disclosure.
Figure 7:
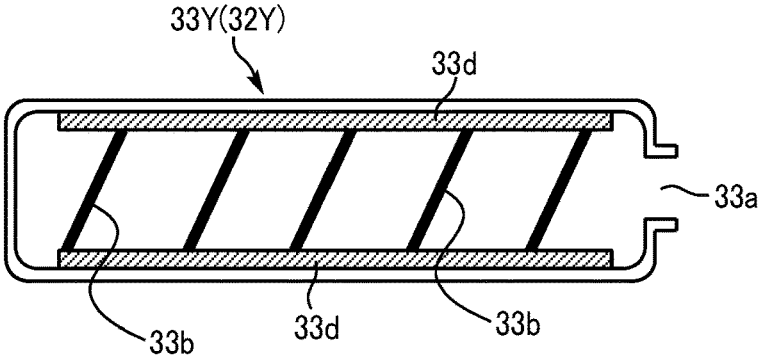
FIG. 7 is a cross-sectional view of a toner container, where the axis of the toner container is on the cross section, according to an embodiment of the present disclosure.

FIG. 6 is a cross-sectional view of the toner container 32Y, where the cross section is orthogonal to the axis X of the toner container 32Y, according to the present embodiment. FIG. 7 is a cross-sectional view of the toner container 32Y, where the axis X of the toner container 32Y is on the cross section, according to the present embodiment. As illustrated in FIGS. 6 and 7, the toner container 32Y (powder container) in the present embodiment is formed so that a convex portion 33*d* having a flat surface portion 33*d*1 projects inward from an inner wall surface 33*e*. In other words, on the inner wall surface 33*e* of the toner container 32Y, in addition to the spiral projection 33*b* described above, the convex portion 33*d* having the flat surface portion 33*d*1 is formed so as to project inward. The flat surface portion 33*d*1 of the convex portion 33*d* is formed so that a virtual plane N including the flat surface portion 33*d*1 passes through the axis X. In other words, the flat surface portion 33*d*1 is formed so as to stand substantially vertically from the inner wall surface 33*e* toward the axis X (rotational center axis). It is to be noted that, in FIGS. 6 and 7, the spiral projection 33*b* is not illustrated in order to facilitate the understanding of the convex portion 33*d*.

By providing the flat surface portion 33*d*1 configured in this way inside the toner container 32Y (container body 33Y), the toner container 32Y (container body 33Y) is rotated in the direction indicated by arrow in FIG. 6. The toner housed inside is well conveyed in the axial direction (the direction in which the axis X extends and is the longitudinal direction) by the spiral projection 33*b*, and is sufficiently stirred by the flat surface portion 33*d*1 of the convex portion 33*d*. In particular, since the virtual plane N including the flat surface portion 33*d*1 is formed so as to pass through the axis X, the toner is moved in the direction indicated by arrow in FIG. 6 while being held by the flat surface portion 33*d*1 with a sufficient grip force, and is well stirred.

In other words, when only the spiral projection 33*b* is formed on the inner wall surface 33*e* of the toner container 32Y and the flat surface portion 33*d*1 (convex portion 33*d*) is not formed, the ability to convey (conveying performance) is sufficient, but the ability to stir the toner (stirring performance) is insufficient. In contrast, in the present embodiment, since the flat surface portion 33*d*1 (convex portion 33*d*) is formed on the inner wall surface 33*e* of the toner container 32Y in addition to the spiral projection 33*b*, in addition to the toner conveying performance, the stirring performance of the toner can also be sufficiently ensured. Thus, the toner contained in the toner container 32Y can be conveyed in the axial direction while being sufficiently stirred. Accordingly, the failure that the toner is not well discharged from the opening 33*a* to the outside of the container (toner discharge failure) is less likely to occur, the problem that the toner adheres to the inner wall surface 33*e*, and the failure such as the amount of toner remaining in the container increases without being able to use up all the toner contained in the container is less likely to occur.

As illustrated in FIG. 6, the flat surface portion 33*d*1 is formed such that an inner surface of the flat surface portion 33*d*1 inside the container body 33 faces not the upstream side but the downstream side with respect to the rotation direction of the toner container 32Y (container body 33Y) when viewed in a cross section orthogonal to the axis X. With such a configuration, the toner can be conveyed to the downstream side in the rotation direction by the flat surface portion 33*d*1 as the container body 33Y rotates, so that the above-described effect of enhancing the stirring of the toner is well performed.

Furthermore, the toner dropped from the flat surface portion 33*d*1 hits to the toner adhered to the inner wall surface 33*e*, which also helps removing the adhered toner from the inner wall surface 33*e*.

Further, in the present embodiment, a toner that does not contain titanium oxide is used as the toner (powder) contained in the toner container 32Y for the purpose of eliminating the concern about safety that has been pointed out in recent years. The toner that does not contain titanium oxide has a lower fluidity than the toner that contains titanium oxide, and sufficient stirring is required. Therefore, the configuration with the flat surface portion 33*d*1 (convex portion 33*d*) is useful as in the present embodiment. The toner in the present embodiment is substantially the same as the comparative toner except that titanium oxide is not used as an external additive.

In the toner container 32Y of the present embodiment, as illustrated in FIG. 6, the flat surface portion 33*d*1 stands up from the inner wall surface 33*e* toward the inside so as to be substantially orthogonal to a parting line S. In other words, the virtual plane N described above and the parting line S at the time of injection molding are substantially orthogonal to each other. The tubular toner container 32Y, in particular, the portion of the container body 33Y, is formed by blow molding or injection blow molding. More specifically, molten resin such as parison is poured into a mold that can be divided by the parting line S, and the resin is inflated with air to form the desired shape. Then, the toner container 32Y is taken out by opening the mold at the parting line S. At this time, in the present embodiment, since the flat surface portion 33*d*1 is formed so as to be substantially orthogonal to the parting line S, the mold is opened at the parting line S so that the toner container 32Y (container body 33Y) can be easily taken out.

As illustrated in FIG. 6, the flat surface portions 33*d*1 are formed at positions facing each other across the axis X when viewed in a cross section orthogonal to the axis X. In other words, when viewed in a cross section orthogonal to the axis X, the two flat surface portions 33*d*1 are disposed at positions at which the phases of the two flat surface portions 33*d*1 are shifted by 180 degrees on the inner wall surface 33*e*. With such a configuration, the toner contained in the toner container 32Y can be stirred in a well-balanced manner by the two flat surface portions 33*d*1.

Further, as illustrated in FIG. 6, the convex portion 33*d* including the flat surface portion 33*d*1 is formed in a substantially mountain shape so that the width of the convex portion 33*d* gradually decreases or narrows from the inner wall surface 33*e* toward the inside. More specifically, in the convex portion 33*d*, the surface on the opposite side of the flat surface portion 33*d*1, which is the surface facing the upstream side in the rotation direction, is formed in a convex-curved surface shape from the inner wall surface 33*e* to the top. With such a configuration, a dead space for toner to stay in the toner container 32Y is less likely to be formed than the case where the surface opposite to the flat surface portion 33*d*1 is formed into a flat surface or a concave-curved surface. Therefore, good conveying performance and good stirring performance of the toner are maintained. Further, by forming the convex portion 33*d* in a substantially mountain shape, the mold can be opened at the parting line S and the toner container 32Y (container body 33Y) can be easily taken out.

With reference to FIG. 7, in the present embodiment, the flat surface portion 33*d*1 (convex portion 33*d*) is formed over the substantially entire area in the axial direction. With such a configuration, the toner in the toner container 32Y can be uniformly stirred over the entire area in the axial direction.

Figure 8:
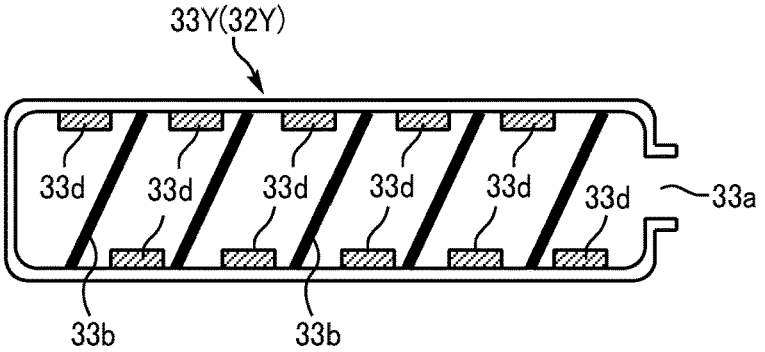
FIG. 8 is a cross-sectional view of a toner container, where the axis of the toner container is on the cross section, according to a modification of an embodiment of the present disclosure.

FIG. 8 is a cross-sectional view of the toner container 32Y, where the axis X of the toner container 32Y is on the cross section, according to a modification of the above embodiment of the present disclosure. As illustrated in FIG. 8, in the toner container 32Y according to the present modification of the above embodiment of the present disclosure, a plurality of flat surface portions 33*d*1 (convex portions 33*d*) are formed by being divided in the axial direction. More specifically, in the present modification as illustrated in FIG. 8, ten convex portions 33*d* are disposed with a gap in the axial direction. By providing the plurality of convex portions 33*d* (flat surface portions 33*d*1) in this manner, the toner is conveyed in the axial direction by the spiral projection 33*b* as the toner container 32Y (container body 33Y) rotates, and is stirred at an appropriate frequency. Such a configuration is useful when adjustments of the degree of toner stirring performance are required. As illustrated in FIG. 8, the plurality of flat surface portions 33*d*1 (convex portions 33*d*) are formed at positions facing each other across the axis X when viewed in a cross section orthogonal to the axis X. More specifically, as illustrated in FIG. 8, a plurality of convex portions 33*d* are alternately disposed on one side (upper part) and the other side (lower part) of the inner wall surface 33*e*. With such a configuration, the toner in the toner container 32Y can be stirred in a well-balanced manner over the entire axial direction as the toner container 32Y (container body 33Y) rotates.

As described above, the toner container 32Y in the present embodiment is a tubular powder container for storing the toner (powder), which is rotatably formed around the axis X and the spiral projection 33*b* is formed inside the toner container 32Y. Further, the convex portion 33*d* having the flat surface portion 33*d*1 is formed so as to project inward from the inner wall surface 33*e*. The flat surface portion 33*d*1 of the convex portion 33*d* is formed so that the virtual plane N including the flat surface portion 33*d*1 passes through the axis X. As a result, the toner contained in the toner container 32Y can be conveyed in the axial direction while being sufficiently stirred.

In the present embodiment, although the toner as a powder is stored in the toner containers 32Y, 32M, 32C, and 32K, toner containers may contain a two-component developer including toner and carrier to be used in image forming apparatuses in which the two-component developer is appropriately supplied to the developing device. Further, in the present embodiment, although the toner container 32Y includes the container body 33Y and the cap 34Y, the configuration of the toner container 32Y (powder container) is not limited to such a configuration. The embodiments of the present disclosure can be applied to any tubular containers that discharge the toner (powder) contained inside the container by rotational drive to the outside of the container. And even in such a case, the same effect as the effect provided by the present embodiment can be obtained.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. Further, for example, the number, position, and the shape of the above components are not limited to those of the present embodiment, and may be changed to any desired number, position, and shape suitable for implementing the embodiments of the present disclosure.

The invention claimed is:

1. A powder container, comprising:

a container body that stores powder and is rotatable around an axis of the container body, the container body having a length which extends in a longitudinal direction;

a spiral projection inside the container body; and a convex portion, different from the spiral projection, including a flat surface portion and protruding inward from an inner wall surface of the container body, wherein the flat surface portion is parallel to the longitudinal direction.

2. The powder container according to claim 1, wherein the container body has a cylindrical surface extending in the longitudinal direction of the container body, and the axis of the container body is a joint of a center of the container body in a cross section of the container body perpendicular to the longitudinal direction.

3. A powder container, comprising:

a container body that stores powder and is rotatable around an axis of the container body;

a spiral projection inside the container body; and a flat surface portion, different from the spiral projection, disposed inward from an inner wall surface of the container body, wherein the flat surface portion is parallel to a longitudinal direction extending along a length of the container body.

4. The powder container according to claim 1, wherein an inner surface of the flat surface portion inside the container body faces a downstream side with respect to a direction of rotation of the container body when viewed in a cross section orthogonal to the axis.

5. The powder container according to claim 1, further comprising another convex portion including another flat surface portion protruding inward from the inner wall surface of the container body, wherein the flat surface portion and said another flat surface portion are at opposite positions across the axis when viewed in a cross section orthogonal to the axis.

6. The powder container according to claim 1, wherein the convex portion gradually narrows inward from the inner wall surface of the container body.

7. The powder container according to claim 1, wherein the flat surface portion extends across substantially an entire length of the container body along the axis of the container body.

8. The powder container according to claim 1, wherein the flat surface portion includes a plurality of parts divided in an axial direction of the container body.

9. The powder container according to claim 8, wherein the plurality of parts are alternately disposed in a staggered manner across the axis when viewed in a cross section including the axis.

10. The powder container according to claim 1, wherein the powder stored in the powder container is toner that does not contain titanium oxide.

11. An image forming apparatus comprising the powder container according to claim 1, wherein the powder container is detachably attached in the image forming apparatus.

12. A powder container, comprising:

a container body that stores powder and has a cylindrical surface extending in a longitudinal direction of the container body;

a spiral projection inside the container body; and a convex portion including a flat surface portion and protruding inward from an inner wall surface of the container body, wherein the flat surface portion protrudes toward a center of the container body in a cross section of the container body, the cross section being perpendicular to the longitudinal direction, and the flat surface portion is parallel to the longitudinal direction.

13. The powder container according to claim 12, further comprising another convex portion including another flat surface portion protruding inward from the inner wall surface of the container body, wherein a virtual line including a point of the flat surface portion and a point of said another flat surface portion passes through the center of the container body.

* * * * *